US009458616B2

(12) United States Patent
Whiteside

(10) Patent No.: US 9,458,616 B2
(45) Date of Patent: Oct. 4, 2016

(54) FLOOR SINK FRAME AND GRATE ASSEMBLY

(75) Inventor: Michael James Whiteside, Chicago, IL (US)

(73) Assignee: MIFAB, Inc., Chicago, IL (US)

( * ) Notice: Subject to any disclaimer, the term of this patent is extended or adjusted under 35 U.S.C. 154(b) by 727 days.

(21) Appl. No.: 13/572,643

(22) Filed: Aug. 11, 2012

(65) Prior Publication Data

US 2013/0036546 A1 Feb. 14, 2013

Related U.S. Application Data

(60) Provisional application No. 61/522,809, filed on Aug. 12, 2011.

(51) Int. Cl.
*E03F 5/06* (2006.01)

(52) U.S. Cl.
CPC ..... *E03F 5/06* (2013.01); *Y10T 29/49826* (2015.01)

(58) Field of Classification Search
CPC ..... E04F 15/024; E04F 15/02411; E04F 15/02405; E04F 15/02476; E04C 2/423; E04C 2/427; E03F 5/06; E02D 29/14
USPC ..... 4/652; 404/2; 47/25.1; 210/163
See application file for complete search history.

(56) References Cited

U.S. PATENT DOCUMENTS 286,951 A * 10/1883 McBee ..... 210/247
2,689,017 A 9/1954 Schmid
D191,184 S 8/1961 Scholz
RE26,366 E * 4/1968 Flegel ..... 404/2
D274,210 S 6/1984 Haggard
4,539,800 A * 9/1985 Furmaga ..... 56/329
D285,406 S 9/1986 Haggard
D290,679 S 7/1987 Thorpe
4,986,025 A * 1/1991 Imperial ..... 47/2
5,074,085 A * 12/1991 Ueda ..... 52/126.6
5,130,016 A * 7/1992 Gavin ..... 210/164
5,291,714 A * 3/1994 Wright et al. ..... 52/664
5,711,106 A * 1/1998 Ellis ..... 47/32
6,290,143 B1 * 9/2001 Vincent et al. ..... 238/2
6,397,408 B1 6/2002 Veloskey et al.
D501,261 S 1/2005 Hauck et al.
7,303,354 B1 * 12/2007 DeCroix ..... 404/25
D590,218 S 4/2009 Jabs
D620,312 S * 7/2010 Jendrass ..... D7/408
D653,990 S * 2/2012 Cherry ..... D11/164
8,511,295 B2 * 8/2013 Buerkle ..... 126/152 B
2006/0048469 A1 * 3/2006 MacLean et al. ..... 52/220.3
2007/0175132 A1 * 8/2007 Spransy et al. ..... 52/263
2010/0258206 A1 * 10/2010 Baker ..... 137/565.01
2012/0311956 A1 * 12/2012 Akkala ..... E04C 2/427 52/660
2014/0360120 A1 * 12/2014 Brisendine et al. ..... 52/582.1

FOREIGN PATENT DOCUMENTS

EP 0506499 A1 9/1992
EP 506499 A1 * 9/1992

* cited by examiner

*Primary Examiner* — Paul R Durand
*Assistant Examiner* — William R Klotz
(74) *Attorney, Agent, or Firm* — Phillips Lytle LLP; David L. Principe

(57) ABSTRACT

A modular design for a floor sink frame and grate assembly. The standard floor grate sizes are whole, one half, and three-quarter. Instead of stocking each of these sizes, the present invention provides a modular system where individual pieces can be stocked and combined to form all of the above configurations.

13 Claims, 3 Drawing Sheets

FLOOR SINK FRAME AND GRATE ASSEMBLY

CROSS-REFERENCE TO RELATED APPLICATION

The present application claims priority benefit of U.S. Provisional Patent Application No. 61/522,809 filed on Aug. 12, 2011, entitled "Floor Sink Frame and Grate Assembly," which is incorporated herein by reference.

FIELD OF THE INVENTION

The present application pertains generally to plumbing and drainage products and specifically to a floor sink frame and grate assembly.

BACKGROUND OF THE INVENTION

A floor sink is a plumbing fixture that is installed in the floor of a structure which is mainly designed to remove any standing water near it. Floor sinks are typically installed in commercial basements, restrooms, kitchens, refrigerator areas, locker/shower rooms, laundry facilities, and near swimming pools. The sinks are typically round or square-shaped. A strainer or grate is typically secured over the floor sink to prevent injury or entry of foreign objects. Depending on the application, a floor sink may be provided with a whole grate, a one-half grate, or a three-quarter grate. For the partial grates, the remaining area of the drain is provided with a solid cover. As a result, standard floor sink designs require stocking of many different sizes of grates and covers to accommodate all of the variations. Accordingly, there is a need for a modular design for a floor sink frame and grate assembly.

SUMMARY OF THE INVENTION

The present invention meets the above-described need by providing an improved design for a floor sink frame and grate assembly. Instead of having separate grates for each of the configurations (one-half, three-quarter, and whole), the present invention provides a modular design where each of the above configurations can be constructed from two stock sizes. The improved design provides flexibility in manufacturing and installing the plumbing fixtures.

BRIEF DESCRIPTION OF THE DRAWINGS

The invention is illustrated in the drawings in which like reference characters designate the same or similar parts throughout the figures of which.

DETAILED DESCRIPTION OF THE INVENTION

The present invention comprises a modular design for a floor sink frame and grate assembly. The standard floor grate sizes are whole, one half, and three-quarter. Instead of stocking each of these sizes, the present invention provides a modular system where individual pieces can be stocked and combined to form all of the above configurations.

Figure 1:
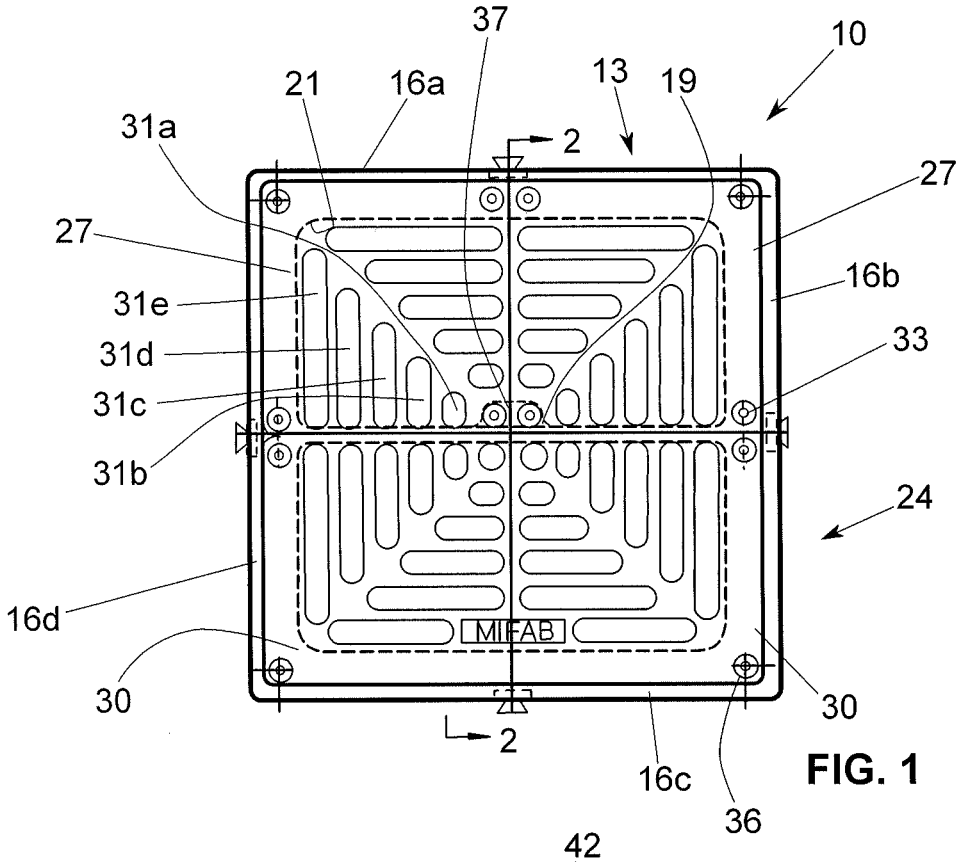
FIG. 1 is a top plan view of the floor sink frame and grate assembly of the present invention in a first configuration.
Figure 5:
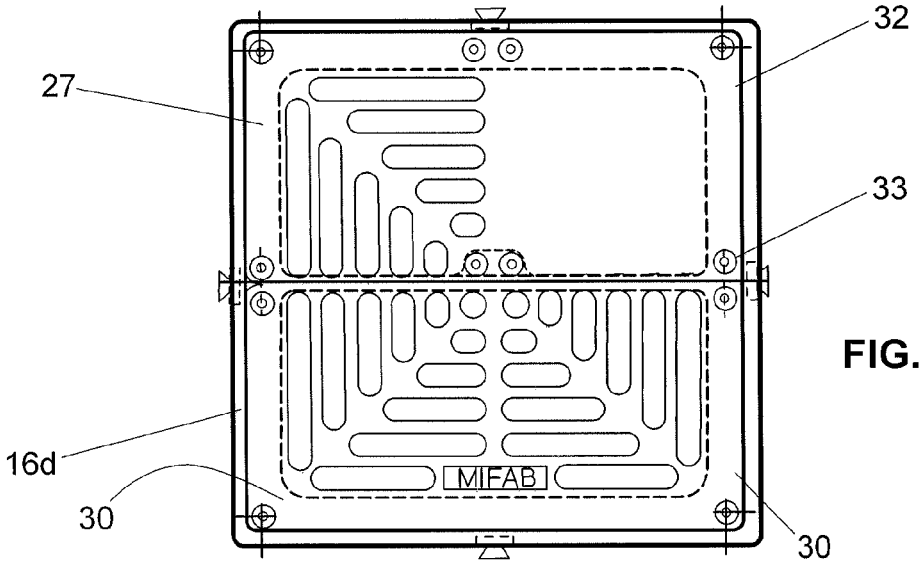
FIG. 5 is a top plan view of an alternate configuration of the first embodiment.
Figure 6:
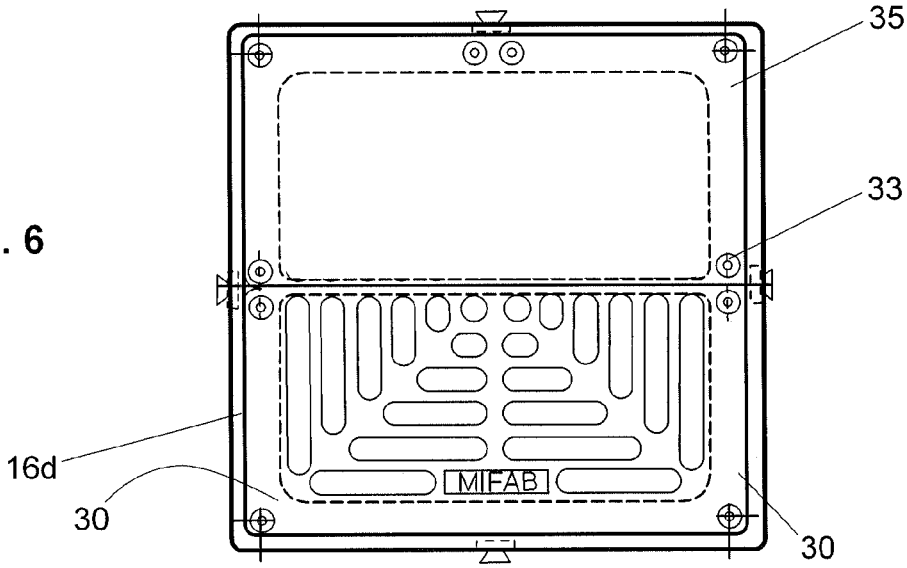
FIG. 6 is a top plan view of another alternate configuration of the first embodiment.

Turning to FIGS. 1-6 generally and initially to FIG. 1, a square shaped frame and grate assembly 10 is shown. The frame 13 has four side walls 16*a*, 16*b*, 16*c*, and 16*d* having approximately the same length and forming a square-shaped opening. The frame 13 also includes a cross member 19 (FIG. 2) that extends through the center of the opening 18. The inner edge 21 of the frame 13 is shown in broken lines. The configuration shown is a whole floor grate assembly 24 formed by two one-quarter grate members 27 and one one-half grate member 30. The one-quarter grate members 27 are substantially square in shape with four sides. The grate members 27,30 may be provided with a plurality of openings 31*a*, 31*b*, 31*c*, 31*d*, and 31*e*. The openings 31*a-e* shown are elongated and each opening, in succession, may be longer than the previous opening. There are two sets of openings 31*a-e* in each of the one-quarter grate members 27 shown. As an alternative, solid members may be substituted for some of the grate members. By substituting a solid member for a grate having openings, the overall floor grate can be configured to create a whole, one half, or three quarter grate. If one of the one-quarter grates 27 is substituted with a one-quarter solid member 32, then a three-quarter grate configuration results as shown in FIG. 5. If both of the one-quarter grate members 27 or if the one-half grate member 30 is substituted with a one-half solid member 35 then a one-half grate configuration results as shown in FIG. 6. The grate members 27, 30 may be secured to frame 13 by means of fasteners 33 disposed through openings 34 in the grate members 27, 30 that align with openings 36 in the frame 13. As shown the openings 34 may be disposed at the corners of each grate member 27, 30. The cross member 19 may be provided with an extended portion 37 toward the middle to provide for attaching the grate members 27 to the cross member 19 in the middle of FIG. 1.

Figure 2:
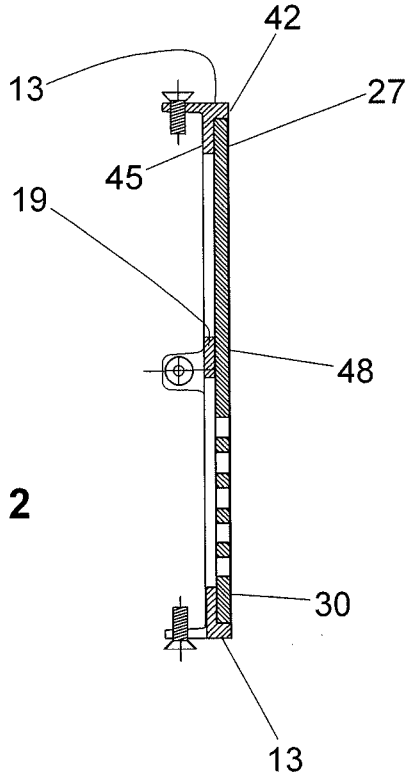
FIG. 2 is a cross-sectional view taken along line 2-2 of FIG. 1.

As best shown in FIG. 2, the frame 13 has an upper surface 42 and a recessed portion 45 that forms a shelf for receiving a grate members 27, 30. The recessed portion 45 may extend around the entire periphery of the frame 13. Cross member 19 may extend from one side of the frame 13 to the other at a midpoint of opposing sidewalls 16*a* and 16*c*. As shown in FIG. 2, the cross member 19 has a top surface 48 that is approximately level with the upper surface 42 of the recessed portion such that the grates 27, 30 are held in an approximately level position.

Figures 3, 4:
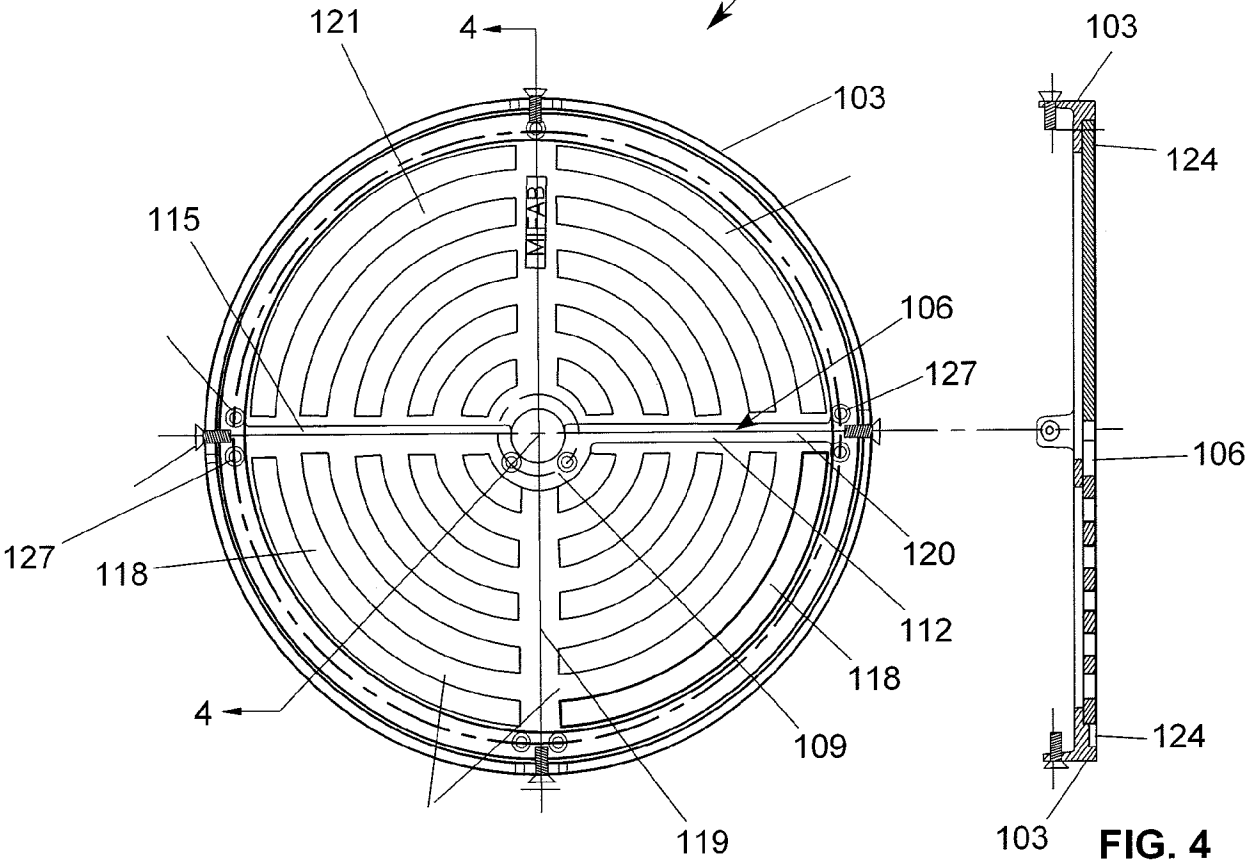
FIG. 3 is a top plan view of an alternate embodiment of the present invention; and, FIG. 4 is a cross-sectional view taken along line 4-4 of FIG. 3.

Turning to FIG. 3, a floor sink frame and grate assembly 100 may also be constructed in a round shape. The sink frame 103 has a round outside shape and also includes a cross member 106 that extends from one side of the frame 103 to the other side across the diameter. In the center the cross member 106 has an arcuate portion 109 extending between to lateral portions 112, 115. The assembly also includes two grate members 118, 121. A one-quarter grate member 118 has an approximately ninety degree angle between two side walls 119, 120. The half grate member 121 has an approximately one hundred-eighty degree arc. The two grate members 118, 121 can be stocked to provide interchangeability between one-half, three-quarter and whole grate assemblies. In FIG. 3, a one-half grate member 121 is combined with two one-quarter grate members 118 to provide a whole grate assembly. By substituting solid members for the one-quarter or one-half grate members 118, other configurations (three-quarter, one-half) can be formed as described above.

In FIG. 4, the cross-sectional view shows a recessed portion 124 formed on the frame 103 providing a shelf that receives the grate assemblies 118, 121. Toward the center of the figure, the cross member 106 provides support and an attachment point for the one-quarter grate assemblies 118. The grate assemblies 118, 121 are attached to the frame 103 by means of fasteners 127 shown around the perimeter of the figure.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention.

What is claimed is:

1. A floor sink frame and grate system, comprising: a frame defining a perimeter surrounding a central opening, the frame having an upstanding wall with an upper surface, the upstanding wall disposed along at least a portion of the perimeter, the frame having a recessed portion disposed in spaced apart relation to the upper surface to form a shelf extending around at least a portion of the perimeter, the frame having a cross member extending from a first side of the frame toward a second side of the frame along a midportion of the frame; at least one first grate member having an area approximately equal to one-quarter of the area of the opening, the first grate member having a plurality of bars and a plurality of elongated openings defined therein to form an open lattice work permitting the passage of liquid through the first grate member, the first grate member having a plurality of openings for receiving fasteners for attaching the first grate member to the recessed portion and the cross member, the at least one first grate member being supported by the recessed portion and the cross member; a second grate member having an area approximately equal to one-half of the area of the opening, the second grate member having a plurality of bars and a plurality of elongated openings defined therein to form an open lattice work permitting the passage of liquid through the second grate member, the second grate member having a plurality of openings for receiving fasteners for attaching the second grate member to the recessed portion, the second grate member being supported by the recessed portion;

a first cover member having an area approximately equal to one-quarter of the area of the opening, the first cover member having a plurality of openings for receiving fasteners for attaching the first cover member to the frame;

a second cover member having an area approximately equal to one-half of the area of the opening, the second cover member having a plurality of openings for receiving fasteners for attaching the second cover member to the frame; and, wherein two or more selected from the group consisting of the first grate member, the second grate member, the first cover member, and the second cover member are combined to form one of a whole, three-quarter, and one-half grate configuration.

2. The floor sink frame and grate system of claim 1, wherein the cross member has a midportion having a width greater than the remainder of the cross member.

3. The floor sink frame and grate system of claim 1, wherein the cross member has a midportion that extends towards the perimeter of the frame.

4. The floor sink frame and grate system of claim 3, wherein the midportion of the cross member is arcuate.

5. The floor sink frame and grate system of claim 1, wherein the overall shape of the frame is rectangular.

6. The floor sink frame and grate system of claim 1, wherein the overall shape of the frame is circular.

7. A method of making a modular floor sink frame and grate system, comprising the steps of: providing a frame defining a perimeter surrounding a central opening, the frame having an upstanding wall with an upper surface, the upstanding wall disposed along at least a portion of the perimeter, the frame having a recessed portion disposed in spaced apart relation to the upper surface to form a shelf extending around at least a portion of the perimeter, the frame having a cross member extending from a first side of the frame toward a second side of the frame along a midportion of the frame; providing a first grate member having an area approximately equal to one-quarter of the area of the opening, the first grate member having a plurality of bars and a plurality of elongated openings defined therein to form an open lattice work permitting the passage of liquid through the first grate member, the first grate member having a plurality of openings for receiving fasteners for attaching the grate member to the frame, the first grate member being supported by the recessed portion and the cross member when the first grate member is installed in the frame; providing a second grate member having an area approximately equal to one-half of the area of the opening, the second grate member having a plurality of bars and a plurality of elongated openings defined therein to form an open lattice work permitting the passage of liquid through the second grate member, the second grate member having a plurality of openings for receiving fasteners for attaching the second grate member to the frame, the second grate member being supported by the recessed portion when the second grate member is installed in the frame; providing a first cover member having an area approximately equal to one-quarter of the area of the opening, the first cover member having a plurality of openings for receiving fasteners for attaching the first cover member to the frame; the first cover member being supported by the recessed portion and the cross member when the cover member is installed in the frame; providing a second cover member having an area approximately equal to one-half of the area of the opening, the second cover member having a plurality of openings for receiving fasteners for attaching the second cover member to the frame; the second cover member being supported by the recessed portion when the cover member is installed in the frame; and combining the grate members and cover members to form one of a whole, three-quarter and one-half grate configuration.

8. The method of claim 7, wherein the cross member has a midportion having a width greater than the remainder of the cross member.

9. The method of claim 7, wherein the cross member has a midportion that extends towards the perimeter of the frame.

10. The method of claim 7, wherein the midportion of the cross member is arcuate.

11. The method of claim 7, wherein the overall shape of the frame is rectangular.

12. The method of claim 7, wherein the overall shape of the frame is circular.

13. A method of making a modular floor sink frame and grate system, comprising the steps of: providing a frame defining a perimeter surrounding a central opening, the frame having an upstanding wall with an upper surface, the upstanding wall disposed along at least a portion of the perimeter, the frame having a recessed portion disposed in spaced apart relation to the upper surface to form a shelf extending around at least a portion of the perimeter, the frame having a cross member extending from a first side of the frame toward a second side of the frame along a midportion of the frame; providing a first grate member having an area approximately equal to one-quarter of the area of the opening, the first grate member having a plurality of bars and a plurality of elongated openings defined therein to form an open lattice work permitting the passage of liquid through the first grate member, the first grate member having a plurality of openings for receiving fasteners for attaching the grate member to the frame, the first grate member being supported by the recessed portion and the cross member when the first grate member is installed in the frame; providing a second grate member having an area approximately equal to one-half of the area of the opening, the second grate member having a plurality of bars and a plurality of elongated openings defined therein to form an open lattice work permitting the passage of liquid through the second grate member, the second grate member having a plurality of openings for receiving fasteners for attaching the second grate member to the frame, the second grate member being supported by the recessed portion when the second grate member is installed in the frame; providing a first cover member having an area approximately equal to one-quarter of the area of the opening, the first cover member having a plurality of openings for receiving fasteners for attaching the first cover member to the frame; the first cover member being supported by the recessed portion and the cross member when the cover member is installed in the frame; providing a second cover member having an area approximately equal to one-half of the area of the opening, the second cover member having a plurality of openings for receiving fasteners for attaching the second cover member to the frame; the second cover member being supported by the recessed portion when the cover member is installed in the frame; and, combining two or more selected from the group consisting of the first grate member, the second grate member, the first cover member and the second cover member to form one of a whole, three-quarter and one-half grate configuration.

* * * * *